United States Patent [19]

Alonzo et al.

[11] Patent Number: 5,036,623

[45] Date of Patent: Aug. 6, 1991

[54] TUMBLER FOR POLISHING SMALL PARTS SUCH AS AMMUNITION CASES AND THE LIKE

[75] Inventors: Lawrence Alonzo, Middletown; Robert Nardiello, Collinsville, both of Conn.

[73] Assignee: Lyman Products Corporation, Middlefield, Conn.

[21] Appl. No.: 433,010

[22] Filed: Nov. 6, 1989

[51] Int. Cl.[5] ..... B24B 19/00

[52] U.S. Cl. ..... 51/7; 51/422; 51/17; 51/163.1

[58] Field of Search ..... 51/422, 424, 17, 163.2, 51/163.1, 70

[56] References Cited

U.S. PATENT DOCUMENTS 3,885,357 5/1975 Hoyt ..... 51/163.2
4,177,608 12/1979 Balz ..... 51/163.2
4,571,963 2/1986 Williams ..... 51/163.1
4,850,151 7/1989 Ditschelein ..... 51/163.2

*Primary Examiner*—Frederick R. Schmidt
*Assistant Examiner*—Lawrence Cruz
*Attorney, Agent, or Firm*—St. Onge Steward Johnston & Reens

[57] ABSTRACT

A tumbler for ammunition cases is described for cleaning of the cases with a granular media inside a bowl. The bowl sits on a removable separator basin in a media sealed manner and both are removably mounted to vibrator. The bowl has an apertured-bottom through which media can be conveniently removed for separation from cases while the vibrator continues to operate. A peripherally-located funnel is provided at the bottom of the separator basin to facilitate discharge of media into a collection pan for reuse. Several embodiments are described.

16 Claims, 2 Drawing Sheets

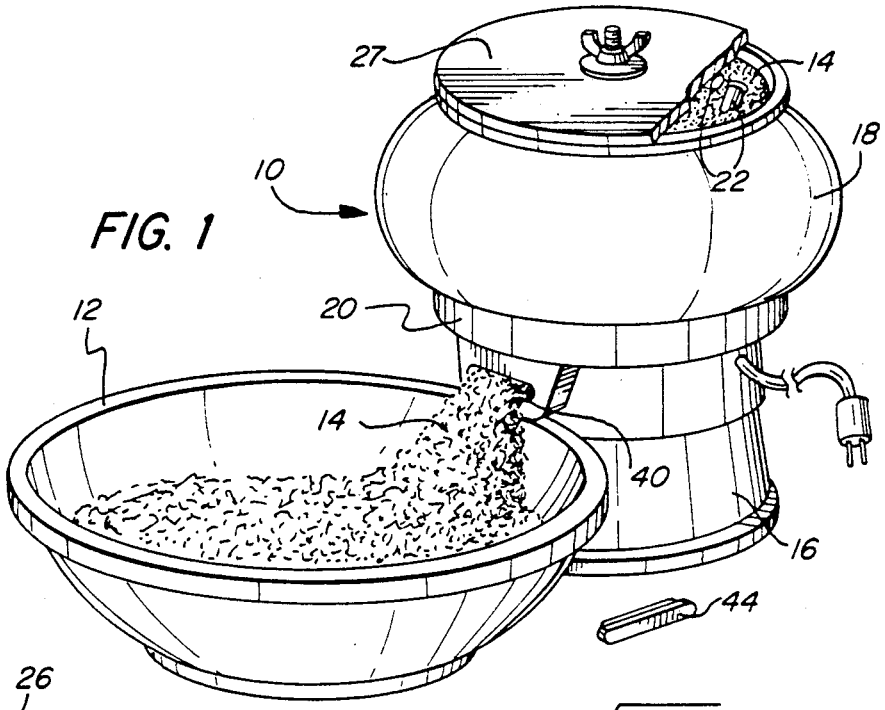
FIG. 1
FIG. 6
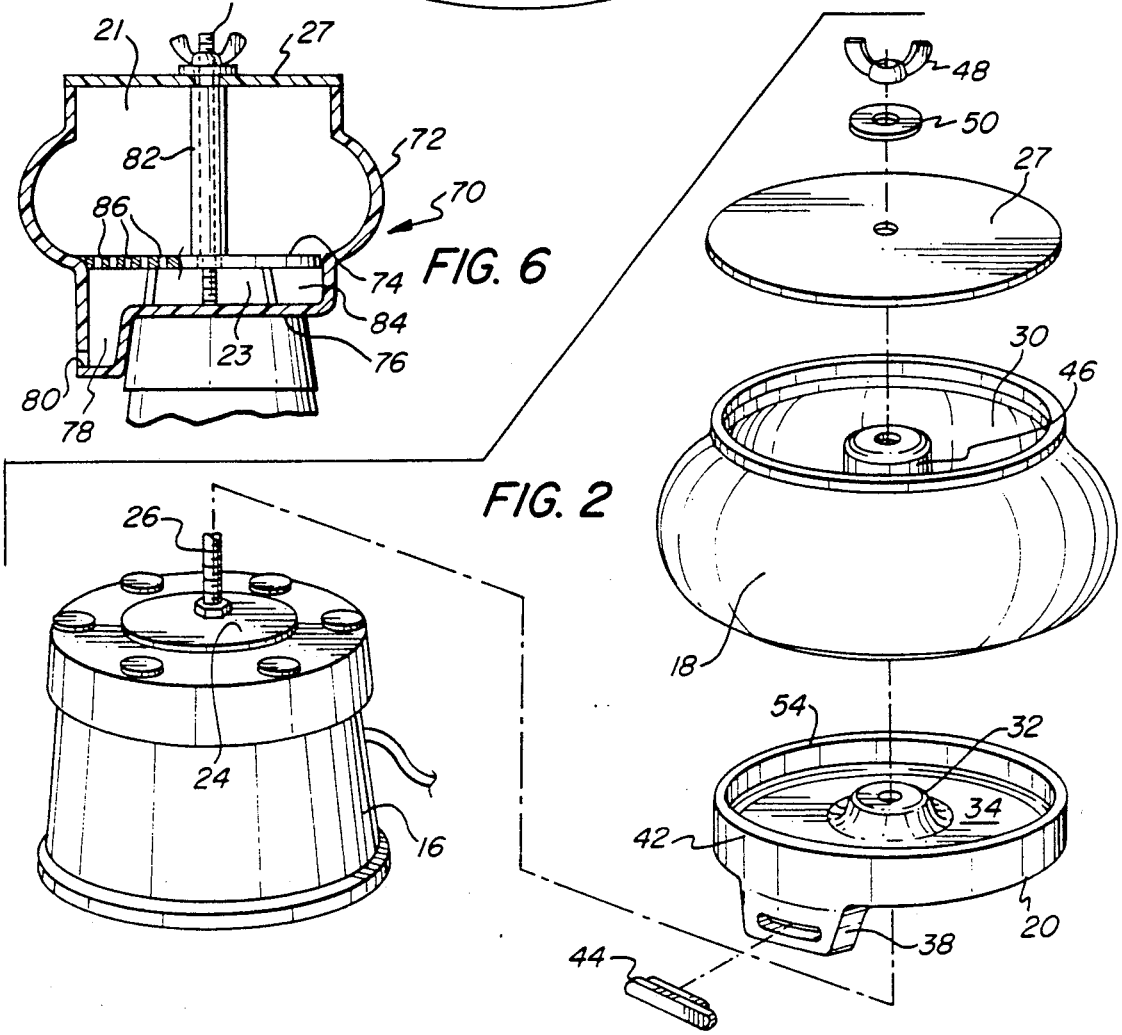
FIG. 2

TUMBLER FOR POLISHING SMALL PARTS SUCH AS AMMUNITION CASES AND THE LIKE

FIELD OF THE INVENTION

This invention relates to a polishing, finishing or cleaning device for small metal or plastic parts.

BACKGROUND OF THE INVENTION

Devices for cleaning, polishing and finishing work pieces using vibrators and a suitable particulate media material are known in the art. For example, U.S. Pat. No. 3,422,577 describes a self-discharging vibratory mill with a weir over which media and workpieces are cascaded for discharge. U.S. Pat. No. 3,693,298 describes a vibrator finishing machine with an improved separating screen. An annular vibratory finishing bowl with a downwardly-directed discharge funnel is shown in U.S. Pat. No. 3,877,178. Other vibratory finishing machines are described and shown in U.S. Pat. Nos. 3,893,266, 4,067,147, 4.161,848, 4,184,290, 4,257,196, 4,693,037 and 4,301,625.

Bowls that are removably mounted on a mechanical vibrator to clean ammunition cases are known and have been available on the marketplace for some time.

SUMMARY OF THE INVENTION

In a small part cleaning device in accordance with the invention, granular cleaning media is conveniently separated from the parts after these have been cleaned. This is achieved by employing a bowl having an upper chamber for holding media and parts and a lower chamber for initially holding and then discharging granular media. The upper and lower chambers are separated from each other by a screen or apertured bottom wall of the upper chamber. A discharge at the lower chamber enables the removal of media to separate it from the parts in the upper chamber while a vibrator on which the bowl is located continues to vibrate.

As described herein for one embodiment in accordance with the invention, the bowl is provided with apertured bottom. The bottom apertures are distributed and sized so as to enable media to pass through while the parts such as ammunition cases remain in the bowl. The polishing bowl seats on a removable media separator basin in a manner whereby media drained into the basin cannot escape and a locking mechanism is used to mount the bowl with the separator basin below it onto a vibrator.

The separator basin is provided with a peripherally-located downwardly extending drain funnel so as to be able to recover drained media for reuse.

With a small part polisher in accordance with the invention, parts such as utensils or ammunition cases can be polished in a known manner. The media is then separated from the parts by allowing media within the separator basin to drain away through the funnel into a pan while the discharge port of the funnel is opened and the vibrator continues to operate. An occasional hand stirring of the polished parts remaining in the bowl may be needed to allow media trapped within the parts to drain away.

It is, therefore, an object of the invention to provide a cleaner for small parts that is convenient to use and facilitates the reuse of cleaning media. The term cleaning or cleaner as used herein means such other small part processing such as polishing and finishing.

BRIEF DESCRIPTION OF DRAWINGS

FIG. 1 is a perspective view of an ammunition case cleaner in accordance with the invention;

FIG. 2 is a perspective exploded view of the cleaner shown in FIG. 1;

FIG. 6 is a partial sectional view of another vibratory cleaning apparatus in accordance with the invention.

DETAILED DESCRIPTION OF DRAWINGS

Figure 4:
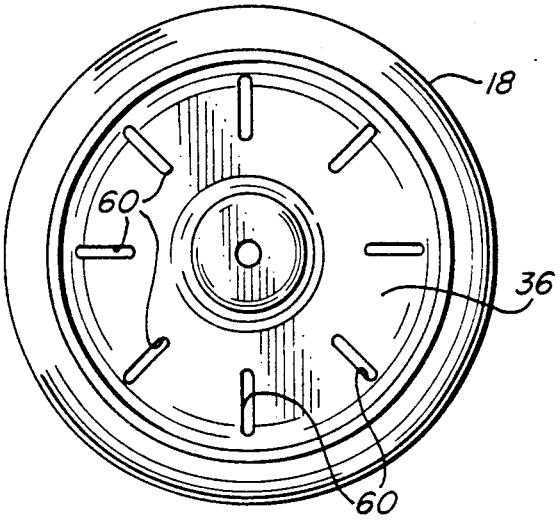
FIG. 4 is a bottom view of the cleaning bowl used in the ammunition case cleaner as shown in FIG. 1.

With reference to FIGS. 1 and 2, an ammunition case cleaner 10 is shown with a pan 12 to separator media 14 when the cleaning process is completed. The cleaner 10 includes a conventional vibrator 16 onto which a cleaning bowl 18 and a separator basin 20 are mounted. The bowl 18 and basin 20 together form an upper chamber 21 and a lower chamber 23 respectively (see FIG. 3).

The vibrator 16 is of a conventional type that is commonly used to clean ammunition cases 21. The vibrator 16 includes a vibration platform 24 from which a threaded shaft 26 extends upwardly to enable the concentric mounting of the separator basin 20, bowl 18 and a cover 27 positioned over the bowl opening 30. Other vibrators can be used.

The separator basin 20 has an inner centrallylocated hub 32 with a central hole sized to freely receive threaded shaft 26. Hub 32 is sufficiently high so as to form an annular basin 34 for holding media 14 that has drained through the apertured bottom 36 (see FIG. 4). A funnel 38 extends downwardly from a peripheral location on separator basin 20 to enable media to be drained away. Funnel 36 has a side-located discharge port 40 that, during the polishing is covered by a stopper 44, but opened during media separation as shown in FIG. 1.

Separator basin 20 has an upwardly-extending peripheral rim 42 on which cleaning bowl 18 is seated in a manner whereby escape of media is prevented. Bowl 18 has an inner hub 46 through which threaded shaft 26 extends to engage a cover 27. A wing nut 48 and washer 50 are used to clamp the cover 27, bowl 18 and separator basin 20 to the vibration platform 24.

Figure 3:
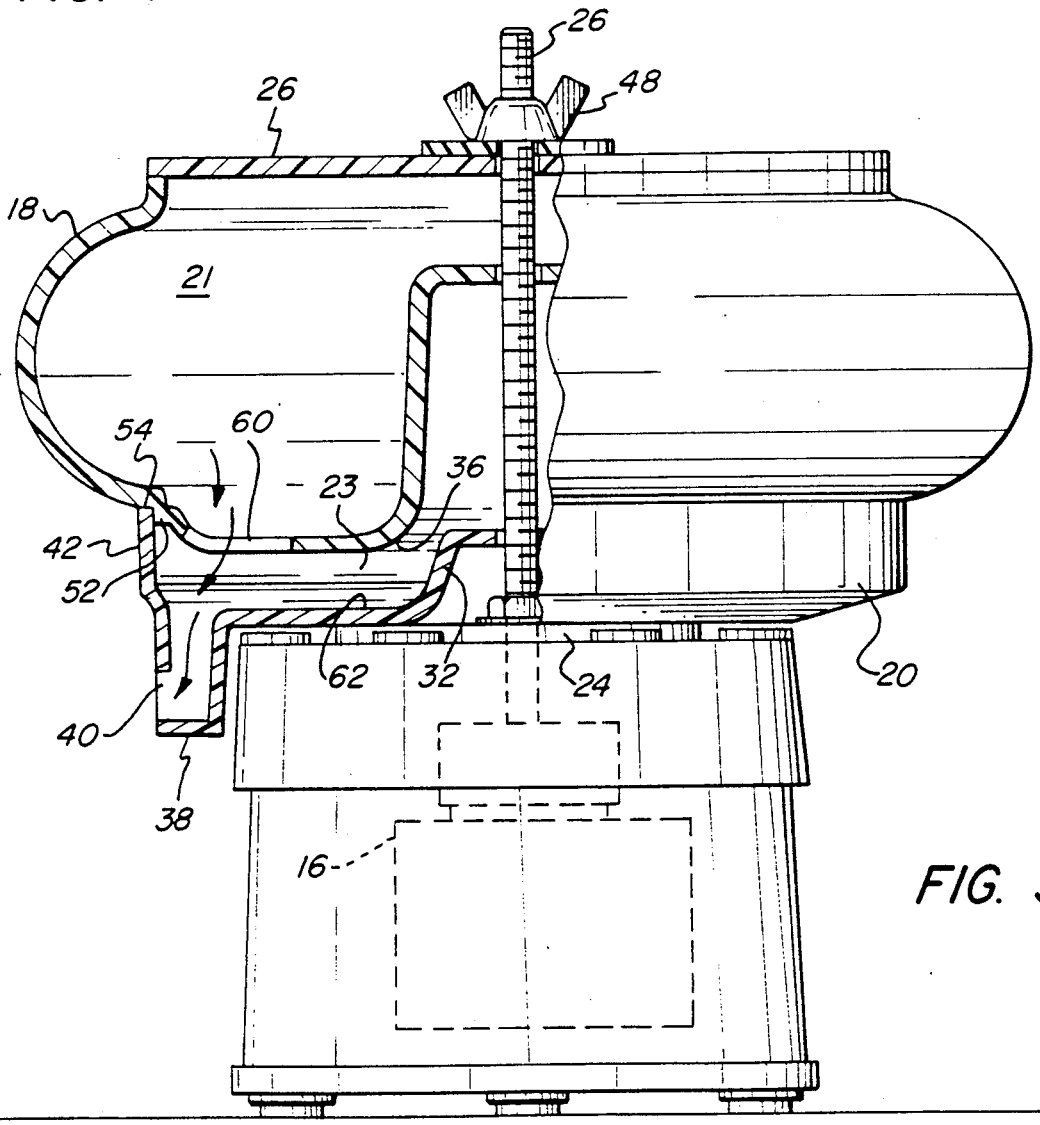
FIG. 3 is a side view in elevation and in partial section of the cleaner of FIG. 1.

FIG. 3 illustrates the assembled ammunition case cleaner 10. Cleaning bowl 18 has an annular downwardly-protruding lip 52 that fits inside of the upper edge 54 of rim 42 of separator basin 20. This assures a nesting fit which, when the components are clamped together as illustrated in FIG. 3, prevents an escape of media from between the separable bowl 18 and separator basin 20.

The bowl bottom 36 and separator basin 20 form lower chamber 23 to enable media 14 that has drained through bowl bottom 36 to be vibrated towards funnel 38. Bowl bottom 36 is apertured with elongate uniformly-distributed slots 60 that are radially oriented and located towards the peripheral end of separator basin 20. Slots 60 are sized to pass media 14 but prevent escape of casings 22. The slots are radially-aligned relative to shaft 26. The separator basin 20 is sufficiently shallow so as to avoid premature drainage of all of the media in the bowl during polishing.

Figure 5:
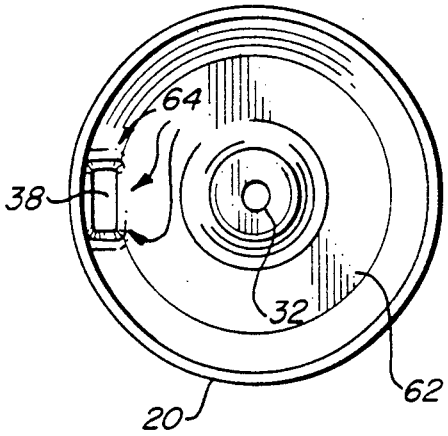
FIG. 5 is a top plan view of a separator basin employed in the polisher of FIG. 1.

As shown in FIGS. 3 and 5, funnel 38 has a generally rectangular crossection and has an oblong discharge port 40 located on the radially outwardly-facing side. The transition of funnel 38 with the bottom 62 of separator basin 20 is smoothly flared at 64 to facilitate drainage of media.

With an ammunition case cleaner in accordance with the invention, casings are tumbled with media in a bowl. When the cleaning of the cases is completed, the media can be conveniently and cleanly separated from the casings. Accordingly, variations of the invention can be made. For example, with reference to FIG. 6, a cleaning apparatus 70 is shown mounted on a suitable vibrator. Apparatus 70 includes a bowl 72 that is separated into upper and lower chambers 21, 23 respectively by a removable screen 74. Screen 74 sits on bottom wall 76 of bowl 72 and overlies a discharge passage 78 terminating at a peripheral discharge port 80. Screen 74 can be clamped to the bottom wall 76 with a suitable tubing 82 affixed to cover 27. Screen 74 overlies a recessed segment 84 in bottom wall 76. The sizes of the screen apertures 86 are selected sufficiently small to keep the parts in the upper chamber 21 while being sufficiently large to enable the granular media to be drained away as described.

Various materials and parts can thus be processed with granular media and conveniently separated. The advantages of the invention as described can thus be understood and its scope determined by the following claims.

What is claimed is:

1. An ammunition casing cleaner for cleaning ammunition cases with a granular cleaning media for reuse, comprising:

a vibrator;

a media separator basin having an upwardly-extending peripheral rim and a generally downwardly-directed peripherally-located discharge funnel, said separator basin being removably mountable to the vibrator;

a cleaning bowl having an upper opening, and a cover sized to removably cover the opening, said bowl having an apertured bottom sized and shaped to seat upon the peripheral rim of the separator basin so as to prevent escape of media therefrom and provide a media collection space and passageway below the bottom; and means for removably mounting the cleaning bowl with the separator basin below it, to the vibrator.

2. The cleaner as claimed in claim 1, wherein the separator basin has an integral central hub so as to form an annular space around the hub to receive media passed through the apertured bottom of the cleaning bowl, and wherein the discharge funnel is an integral part of the separator basin and extends downwardly below an outer bottom surface of the separator basin.

3. The cleaner as claimed in claim 2 wherein the funnel has a discharge port facing radially outwardly.

4. The cleaner as claimed in claim 1 wherein the funnel has a generally rectangular shape.

5. The cleaner as claimed in claim 1 wherein the discharge funnel is generally oblong.

6. The cleaner as claimed in claim 2 and further including an elongate stopper sized commensurate with the discharge port for closure thereof.

7. The cleaner as claimed in claim 1 wherein the bowl has an annular protruding lip extending from the bowl bottom, said lip being sized to fit snugly with and within the rim of the separator basin.

8. The cleaner as claimed in claim 1 wherein the apertures in the bottom of said cleaning bowl are generally oblong.

9. The cleaner as claimed in claim 1 wherein the apertures in the bottom of said cleaning bowl are generally radially arranged.

10. The cleaner as claimed in claim 1 wherein said media separator basin is sufficiently shallow so as to avoid premature drainage of all of the media from said cleaning bowl during cleaning.

11. A small parts cleaner for cleaning parts with a granular cleaning media, comprising:

a vibrator;

a media separator basin having an upwardly-extending peripheral rim and a generally downwardly-directed peripherally-located discharge funnel, said separator basin being removably mountable to the vibrator said separator basin being sufficiently shallow so as to avoid premature drainage of all of the media from said cleaning bowl during cleaning;

a cleaning body having an upper opening, said bowl having an apertured bottom sized and shaped to seat upon the peripheral rim of the separator basin so as to prevent escape of media therefrom and provide a media collection space and passageway below the bottom; and means for removably mounting the cleaning bowl with the separator basin below it, to the vibrator.

12. The small parts cleaner as claimed in claim 11, wherein the bowl has an annular protruding lip extending from the bowl bottom, said lip being sized to fit snugly with and within the rim of the separator basin.

13. The small parts cleaner as claimed in claim 11 wherein the apertures in the bottom of said cleaning bowl are generally oblong.

14. The small parts cleaner as claimed in claim 11 wherein the apertures in the bottom of said cleaning bowl are generally radially arranged.

15. The small parts cleaner as claimed in claim 11 wherein said cleaning bowl is generally upright, and also including a removable cover to overlie the upper opening of said cleaning bowl.

16. A small parts cleaner for cleaning parts with granular cleaning media, comprising:

a vibrator;

a cleaning bowl comprising an upper-located bowl component and a lower-located basin component, said bowl component having an opening for receiving parts and granular cleaning media into said bowl component, said bowl component having a bottom including apertures, said apertures sized to retain parts in said bowl component while passing granular cleaning media through to said basin component, said basin component for receiving granular cleaning media from said bowl component through said apertured bottom of said bowl component, said basin component having a bottom wall including a discharge port, said discharge port for removing granular cleaning media from said basin; and means for mounting said bowl component upon said basin component and for mounting said cleaning bowl to said vibrator.

* * * * *